US010562595B2

(12) United States Patent
Williams et al.

(10) Patent No.: US 10,562,595 B2
(45) Date of Patent: Feb. 18, 2020

(54) PIVOTING AND FOLDING RIGID PANEL BOAT TOP

(71) Applicant: Xtreme Marine Corporation, Maryville, TN (US)

(72) Inventors: Anthony Duane Williams, Alcoa, TN (US); Bradley Michael Nemeth, Wilton Manors, FL (US)

(73) Assignee: Xtreme Marine Corporation, Maryville, TN (US)

( * ) Notice: Subject to any disclaimer, the term of this patent is extended or adjusted under 35 U.S.C. 154(b) by 0 days.

(21) Appl. No.: 16/182,076

(22) Filed: Nov. 6, 2018

(65) Prior Publication Data

US 2019/0135382 A1 May 9, 2019

Related U.S. Application Data

(60) Provisional application No. 62/583,544, filed on Nov. 9, 2017.

(51) Int. Cl.
*B63B 17/02* (2006.01)

(52) U.S. Cl.
CPC ..... *B63B 17/02* (2013.01); *B63B 2017/026* (2013.01)

(58) Field of Classification Search
CPC ..... B63B 17/02; B63B 2017/026
See application file for complete search history.

(56) References Cited

U.S. PATENT DOCUMENTS

| | | | | |
|---|---|---|---|---|
| 5,931,114 | A | 8/1999 | Bartholomew | |
| 6,439,150 | B1 | 8/2002 | Murphy et al. | |
| 6,848,387 | B1 | 2/2005 | Zalanka | |
| 7,418,918 | B2 * | 9/2008 | Bierbower | B63B 17/02 114/361 |
| 7,520,240 | B2 * | 4/2009 | Tufte | B63B 17/02 114/361 |
| 7,571,691 | B2 | 8/2009 | Russikoff | |
| 7,784,420 | B2 * | 8/2010 | Tufte | B63B 17/02 114/361 |
| 7,895,964 | B2 | 3/2011 | Russikoff | |
| 8,025,194 | B2 | 9/2011 | Jesewitz | |
| 8,297,484 | B2 | 10/2012 | Jesewitz et al. | |
| 8,495,967 | B2 | 7/2013 | Williams et al. | |
| 8,857,366 | B2 | 10/2014 | Russikoff | |
| 8,905,281 | B2 | 12/2014 | Jesewitz | |
| 9,038,875 | B2 | 5/2015 | Jesewitz | |

(Continued)

*Primary Examiner* — S. Joseph Morano
*Assistant Examiner* — Jovon E Hayes
(74) *Attorney, Agent, or Firm* — Luedeka Neely Group, P.C.

(57) ABSTRACT

A top mountable on a boat. The top includes a tower having an upper tower portion pivotally connected to a lower tower portion, and a cover connected to the upper tower portion and having a plurality of rigid panels hingedly connected to one another. The top is pivotable and foldable from an erected orientation in which the upper rigid tower portion is positioned directly above the lower rigid tower portion and the rigid panels are oriented in a parallel planar relationship above the upper rigid tower portion to a storage orientation. In the storage orientation the upper rigid tower portion is pivoted relative to the to the lower rigid tower portion and the rigid panels are oriented in a folded orientation relative to one another.

20 Claims, 17 Drawing Sheets

(56) References Cited

U.S. PATENT DOCUMENTS

| | | | | |
|---|---|---|---|---|
| 9,114,854 | B2 * | 8/2015 | Williams | B63B 17/02 |
| 9,114,855 | B2 | 8/2015 | Nemeth | |
| 9,139,258 | B2 | 9/2015 | Russikoff | |
| 9,139,259 | B2 | 9/2015 | Williams et al. | |
| 9,227,699 | B2 * | 1/2016 | Raiter | B63B 1/12 |
| 9,365,264 | B2 * | 6/2016 | Perosino | F16B 1/00 |
| 9,434,451 | B1 | 9/2016 | Ostmeyer et al. | |
| 10,053,192 | B2 | 8/2018 | Russikoff | |
| 2015/0216273 | A1 * | 8/2015 | Akin | H02J 7/025 135/16 |
| 2019/0135382 | A1 * | 5/2019 | Williams | B63B 17/02 |

* cited by examiner

PIVOTING AND FOLDING RIGID PANEL BOAT TOP

CROSS-REFERENCE TO RELATED APPLICATION

This application claims priority to U.S. Provisional Application No. 62/583,544 filed Nov. 9, 2017, entitled Pivoting and Folding Rigid Panel Boat Top, incorporated herein by reference in its entirety.

FIELD

The present disclosure relates to tops and covers for boats. More particularly, the disclosure relates to a pivoting and folding boat top made of rigid panels.

BACKGROUND

Improvement is desired in the provision of tops for boats.

In particular, what is desired is a pivoting and folding top for boats incorporating rigid panels.

SUMMARY

The above and other needs are met by tops mountable on a boat and including rigid panels for providing a cover.

In one aspect a top includes a lower rigid tower portion; an upper rigid tower portion pivotally connected to the lower rigid tower portion; and a cover connected to the upper tower portion, the cover having a plurality of rigid panels hingedly connected to one another.

The top is pivotable and foldable from an erected orientation in which the upper rigid tower portion is positioned directly above the lower rigid tower portion and the rigid panels are oriented in a parallel planar relationship above the upper rigid tower portion to a storage orientation. In the storage orientation the upper rigid tower portion is pivoted relative to the to the lower rigid tower portion and the rigid panels are oriented in a folded orientation relative to one another.

In another aspect, a top mountable on a boat includes a pair of spaced apart lower rigid tower portions; a pair of spaced apart upper rigid tower portions, each upper rigid tower portions pivotally connected to one of the lower rigid tower portions; and a cover connected to each of the upper tower portions, the cover comprising a plurality of rigid panels hingedly connected to one another, The top is pivotable and foldable from an erected orientation in which the upper rigid tower portions are each positioned directly above one of the lower rigid tower portions and the rigid panels are oriented in a parallel planar relationship above the upper rigid tower portions to a storage orientation. In the storage orientation, the upper rigid tower portions are pivoted relative to the to the lower rigid tower portions and the rigid panels are oriented in a folded orientation relative to one another.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

With initial reference to FIGS. 1-7, there is shown a pivoting and folding rigid panel boat top 10 according to the disclosure that is mountable on boat, and is configured to provide a watersports tower 12, and includes a cover 14 made of a plurality of rigid panels.

As shown in this embodiment, the cover 14 is made of two rigid panels, a forward panel 16*a* and an aft panel 16*b* hingedly connected to one another by a hinge 18. Latches 20 are utilized to latch the rigid panels 16*a* and 16*b* together when the cover 14 is in the erected or deployed orientation. The boat top 10 is configured to provide quick and easy deployment and stowage.

Figure 1:
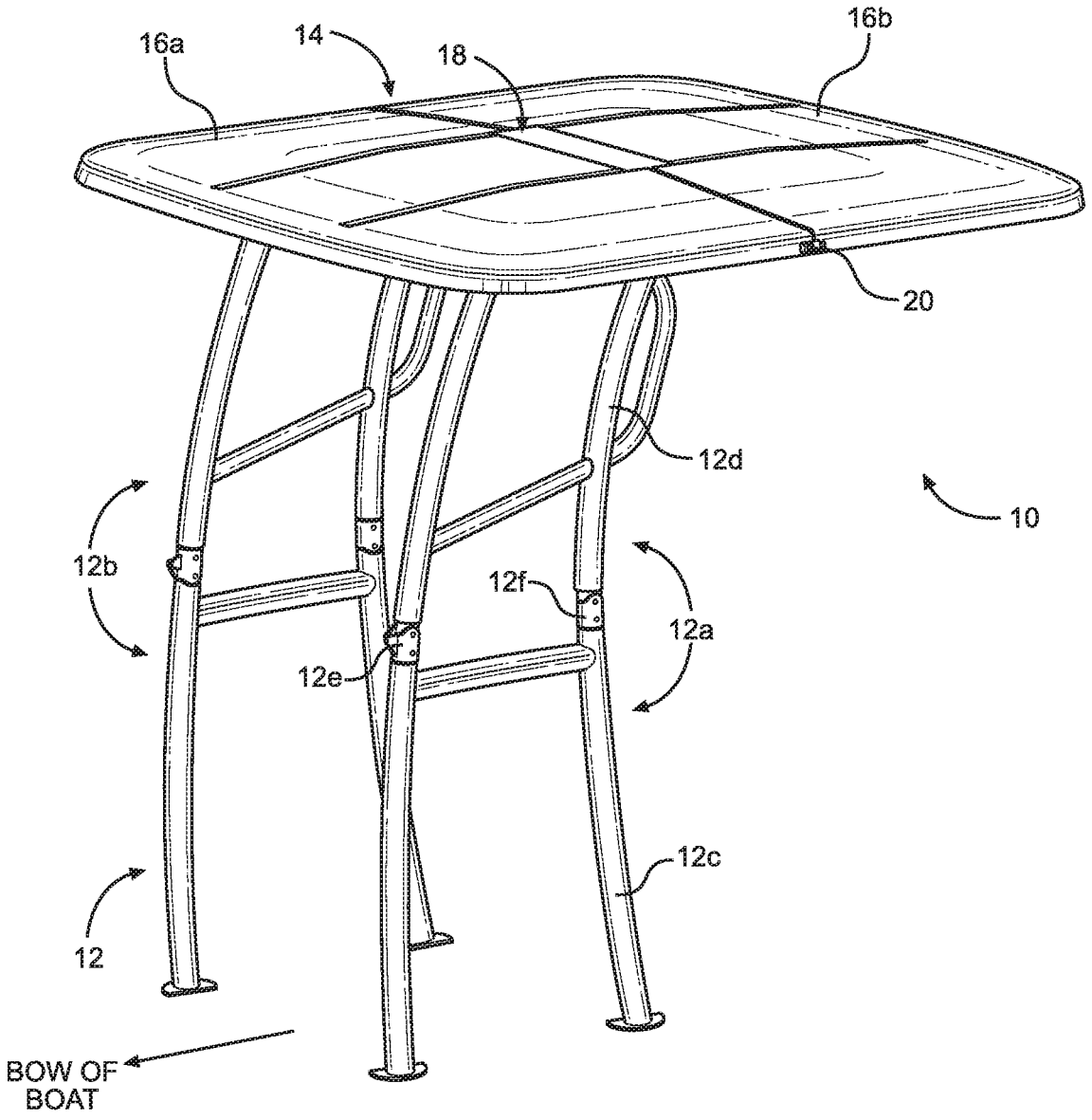
FIGS. 1 and 2 are perspective views of a pivoting and folding rigid panel boat top according to the disclosure.

The tower 12 preferably has a port tower 12*a* and a starboard tower 12*b*, each of substantially the same construction. However, it will be appreciated that only one of the port tower 12*a* or the starboard tower 12*b* may be utilized with the cover 14, but it is preferred that both be utilized. For the sake of brevity, only the port tower 12*a* is described, the starboard tower 12*b* being of substantially the same construction to be on the starboard side of a boat. The terms forward aft, port and starboard are relative to a bow of the boat as indicated in FIG. 1.

The port tower 12*a* includes a lower tower portion 12*c* and an upper tower portion 12*d* hingedly connected to the lower tower portion 12*c* by a hinge 12*e* so that the upper tower portion 12*d* can pivot when a latch 12*f* is released. The latch 12*f* is engaged to maintain the tower 12 in the erected orientation. The upper tower portion 12*d* may be bolted or otherwise connected to the forward rigid panel 16*b*. The lower tower portion 12*c* connects to the floor or hull or like of the boat.

The rigid panels 16*a* and 16*b* that provide the cover 14 are desirably of molded, plastic construction. The panels 16*a* and 16*b* are sufficiently rigid to be self-supporting and are hingedly connected by the hinge 18. The panels 16*a* and 16*b* may be molded to include features such as rain gutters or drip guards, and various utilitarian and appearance features, such as areas to locate lights on the underside and top surfaces, ribs on the top surface that provide a top storage rack, receptacles that allow fishing poles to be held along the perimeter, pockets on the underside to store smaller items such as a wallet or phone, internal pipes that are wire chases to allow electrical devices to be easily connected to the rigid panels with the wires concealed inside the panels.

Figure 3:
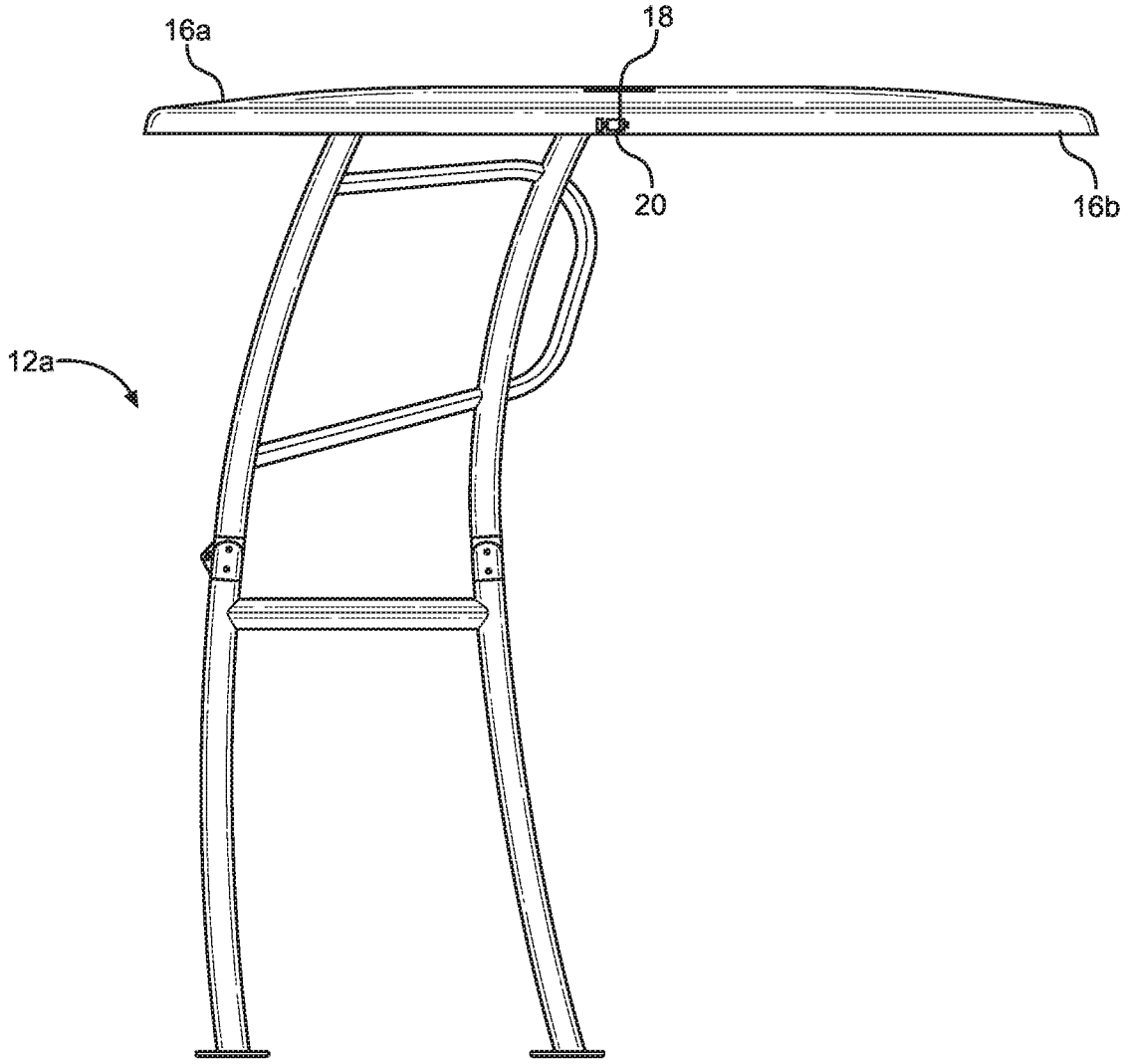
FIGS. 3-7 depict pivoting and folding of the boat top of FIGS. 1 and 2 from a use or erect orientation to a storage position.

Also, as will be observed, the rigid panels 16*a* and 16*b* are crowned so they are higher at the top center of the cover 14 provided by the panels 16*a* and 16*b*. The crowned configuration of the rigid panels 16*a* and 16*b* is advantageous so that rain water or the like can run off in all directions without puddling. The crowned configuration also offers a vertical spaced, butt joint formed with the hinge 18 and latches 20. Thus, the cover 14 may have the hinge 18 with the latches 20 placed lower at the sides and/or on the underside of the rigid panels 16*a* and 16*b*. When viewed from the side, such as shown in FIG. 3, a vertical distance is provided between the hinge 18 and the latches 20 at the sides. This enables the panels 16*a* and 16*b* to be cantilevered from the another and self-supporting.

The hinge 18 is preferably a butterfly hinge, but other types of hinges may be used. The butterfly hinge includes a butt hinge with two pivoting ends that create a desirable spacing to allow folding of panels that overlap. Butterfly hinges are preferred as they facilitate positioning of the panels 16*a* and 16*b* to overlap where they abut to seal against water leaking through the joint between the panels 16*a* and 16*b*. If desired gaskets and the like may also be utilized at the joint.

The latches 20 are preferably lockable latches or knobs that maintain the abutting panels 16*a* and 16*b* adjacent and abutting one another when desired during use.

Figure 2:
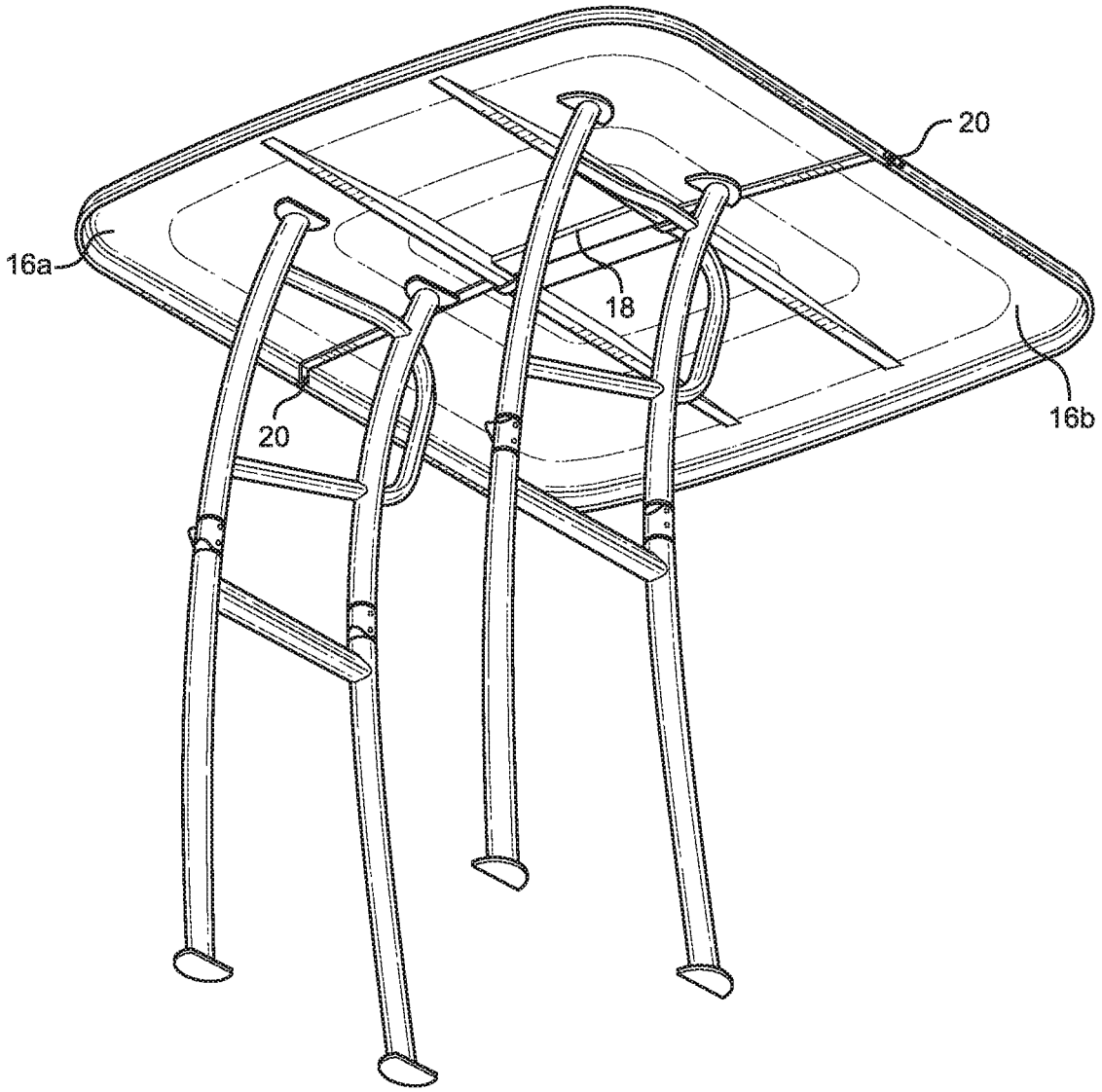
Figure 4:
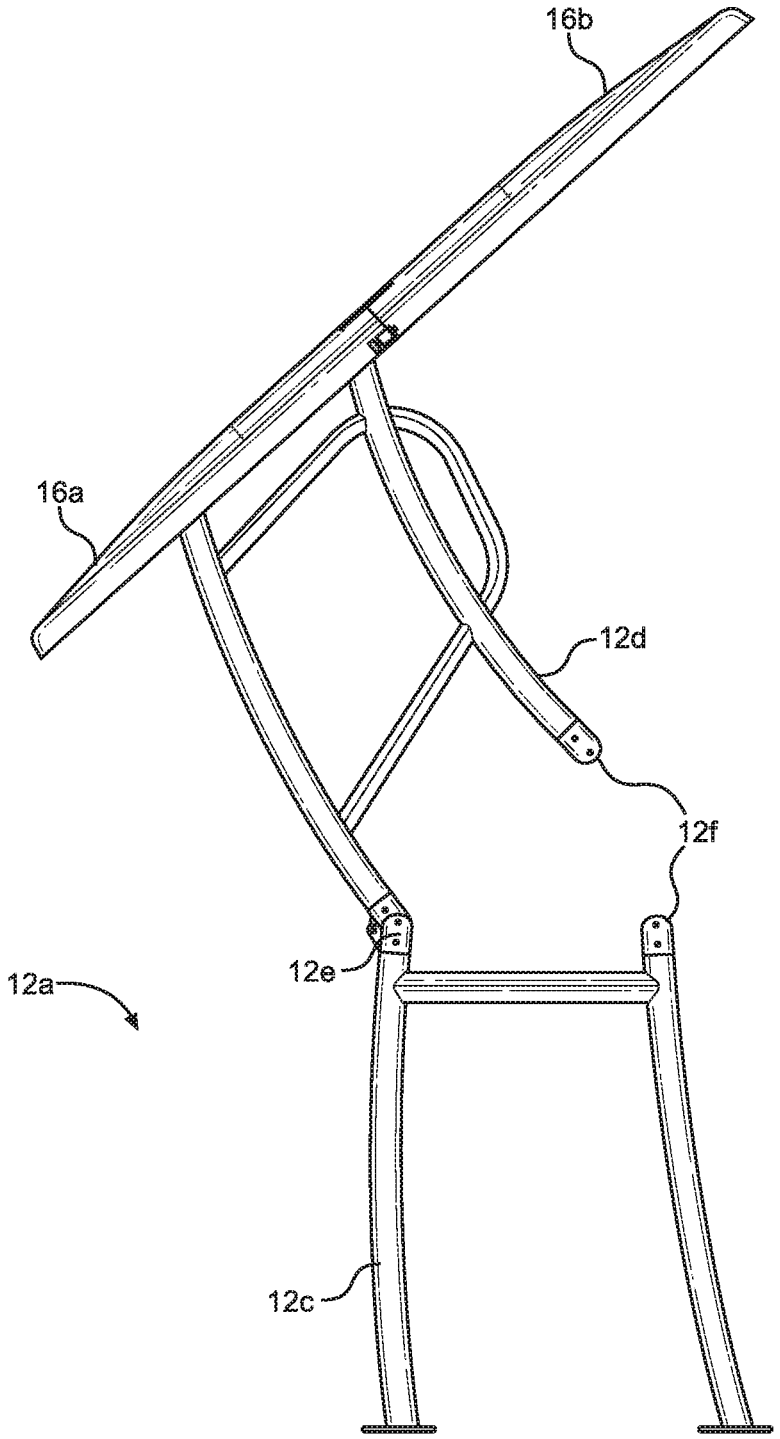
Figure 5:
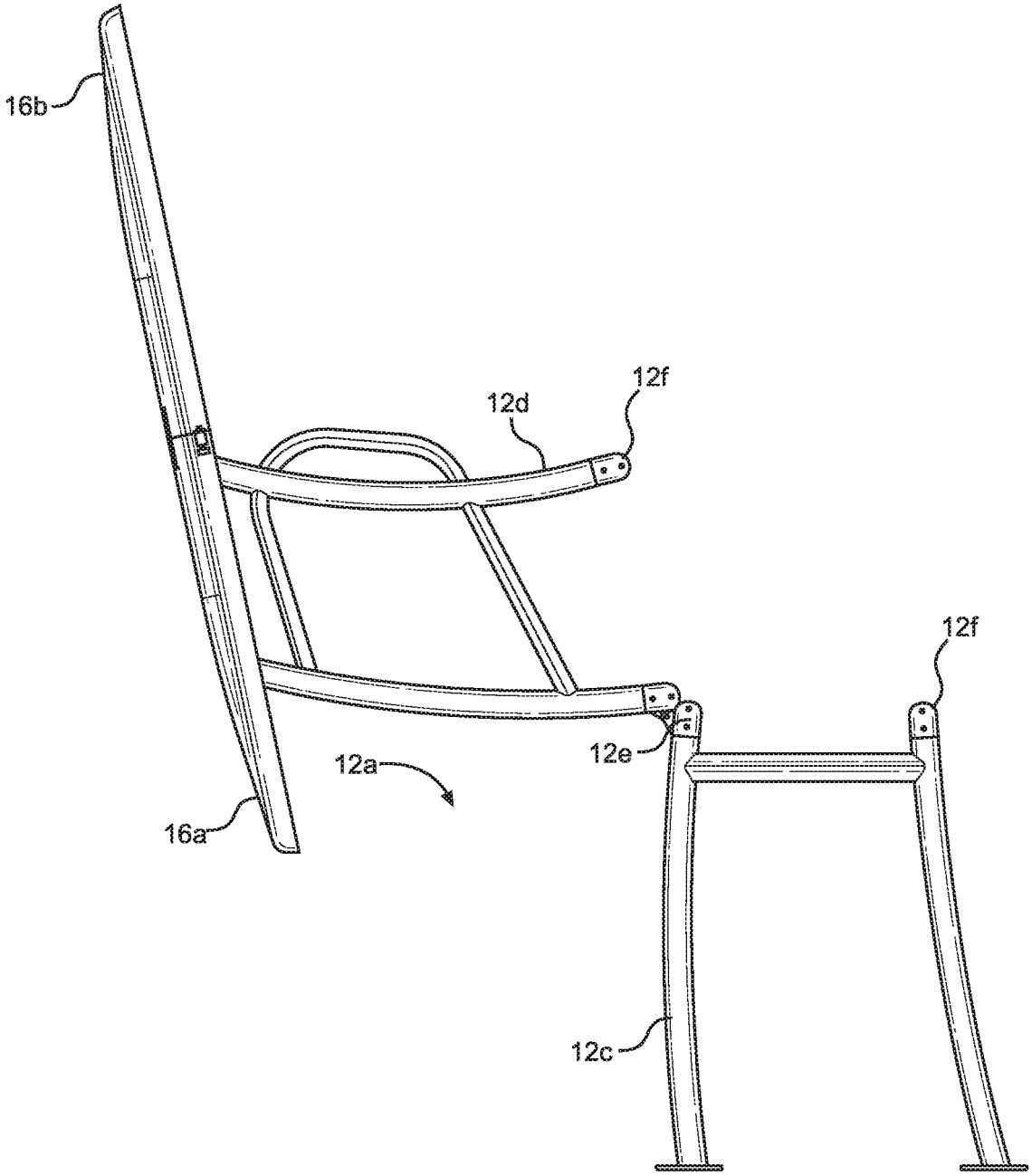
Figure 6:
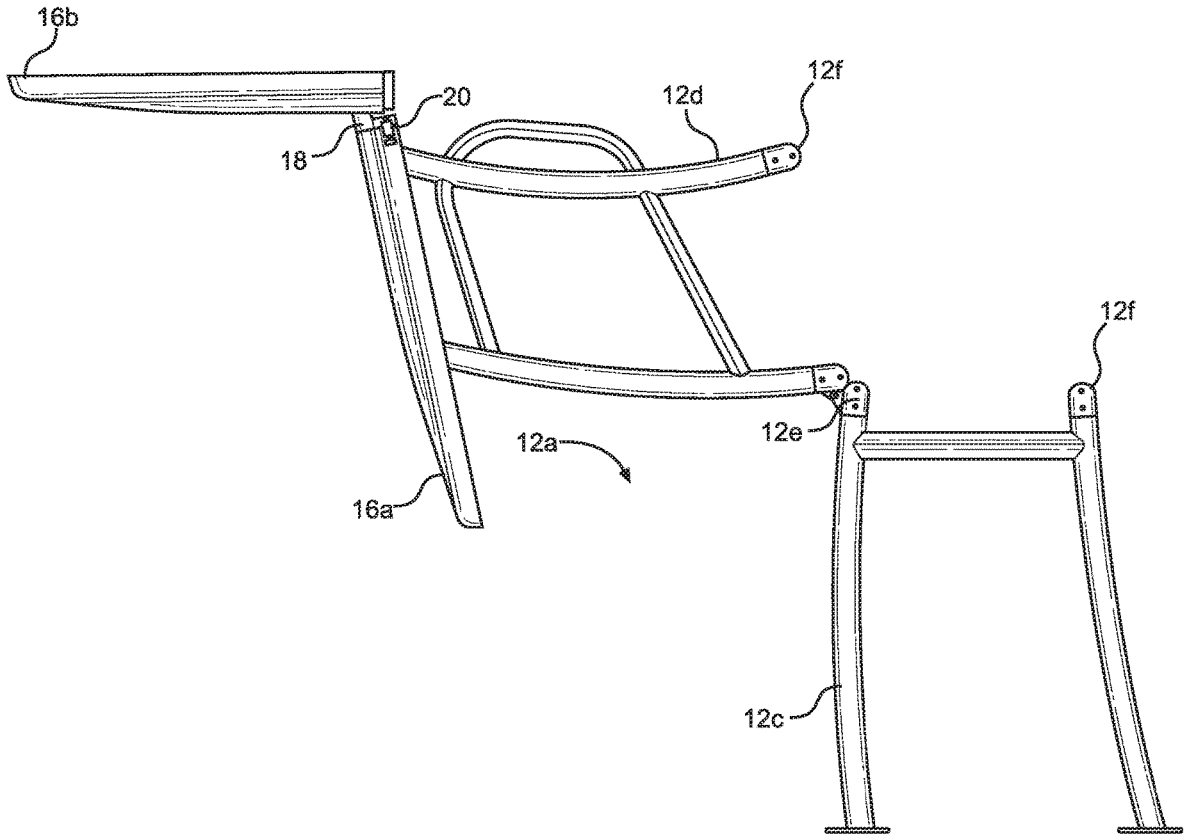
Figure 7:
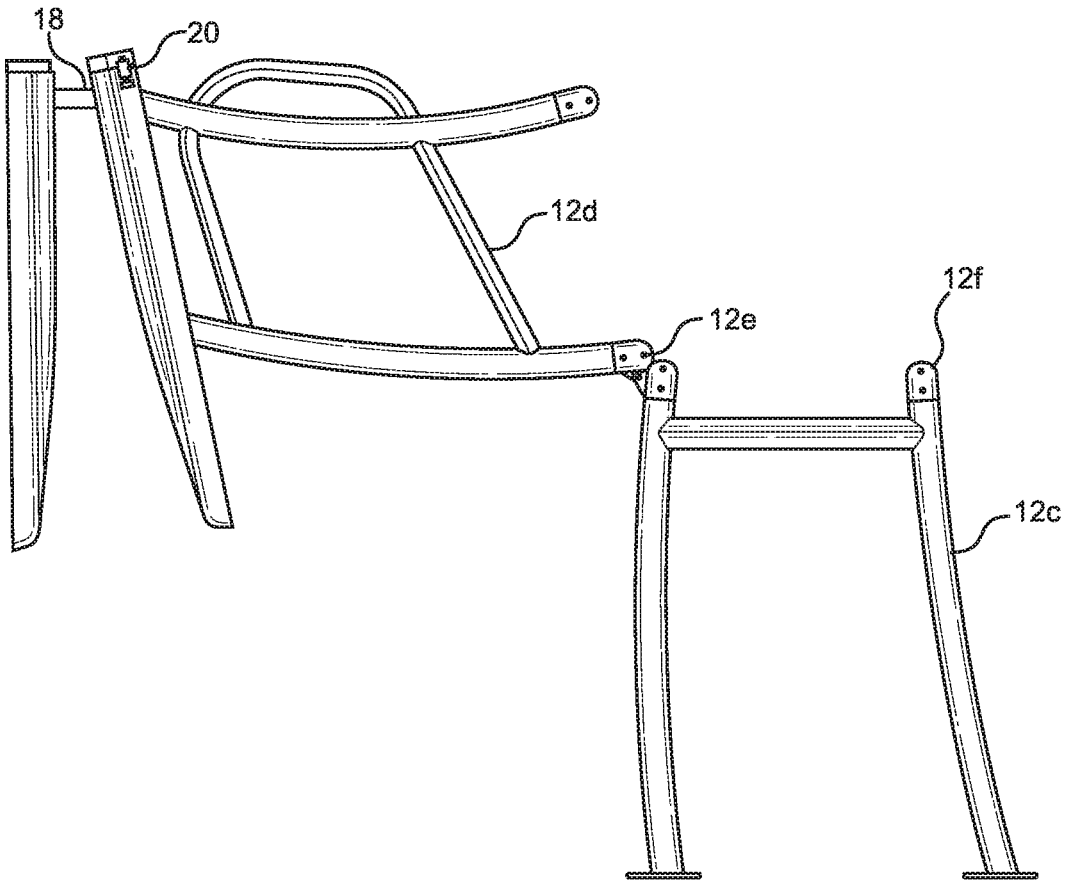

FIGS. 3-7 depict pivoting and folding of the boat top 10 of FIGS. 1 and 2 from a use or erect orientation to a storage position. As shown, to orient the top 10 from an erected configuration (FIG. 3) to a stowed configuration (FIG. 7), the latch 12*f* is disengaged, and the upper tower portion 12*d* is pivoted forward as seen in FIG. 4 until it is fully pivoted to the position as shown in FIG. 5. Next, as seen in FIG. 6, the latches 20 are disengaged and the aft panel 16*b* is pivoted or folded forward. The panel 16*b* is continued to be pivoted forward until it is substantially hanging down and parallel with the forward panel 16*a*, as shown in FIG. 7 to provide a compact storage condition for the top 10.

Thus, as shown the top 10 is pivotable and foldable from an erected orientation in which the upper rigid tower portion 12*d* is positioned directly above the lower rigid tower portion 12*c* and the rigid panels 16*a* and 16*b* are oriented in a parallel planar relationship above the upper rigid tower portion 12*d* to a storage orientation in which the upper rigid tower portion 12*d* is pivoted relative to the to the lower rigid tower portion 12*c* and the rigid panels 16*a* and 16*b* are oriented in a folded orientation relative to one another. The panels 16*a* and 16*b* are likewise connected to the starboard tower 12*b* which is pivoted in a similar manner and simultaneously with the port tower 12*a*.

FIGS. 8-11 show another embodiment of a pivoting and folding rigid panel boat top 30 according to the disclosure. The top 30 is configured to provide a watersports tower 32, and includes a cover 34 made of a plurality of rigid panels.

In this embodiment, the cover 34 is made of three rigid panels, a forward panel 36*a*, a mid panel 36*b*, and an aft panel 36*c*. A hinge 38*a* is located between the forward panel 36*a* and the mid panel 36*b*, and a hinge 38*b* is located between the mid panel 36*b* and the aft panel 36*c*. Latches 40*a* and 40*b* are utilized to latch the rigid panels 36*a* and 36*b* together, and the panels 36*b* and 36*c*, respectively, when the cover 34 is in the erected or deployed orientation. The boat top 30 is configured to provide quick and easy deployment and stowage.

The tower 32 is substantially identical to the tower 12, and includes a port tower and a starboard tower. Only the port tower portion is shown in FIGS. 8-11. For the sake of brevity, only the port tower 12*a* is described. The port and starboard sides of the tower 32 includes a lower tower portion 32*a* and an upper tower portion 32*b* hingedly connected by a hinge 32*c* so that the upper tower can pivot when a latch 32*d* is released. The latch 32*d* is engaged to maintain the tower 32 in the erected orientation. The upper tower portion 32*b* may be bolted or otherwise connected to the mid rigid panel 36*b*. The lower tower portion 32*a* connects to the floor or hull or the like of the boat.

The rigid panels 36*a*-36*c* are desirably of molded, plastic construction in the manner of the panels 16*a* and 16*b*. The panels 36*a*-36*c* are sufficiently rigid to be self-supporting and are hingedly connected by the hinges 38*a* and 38*b*. The panels 36*a*-36*c* may be molded to include features such as rain gutters, and various utilitarian and appearance features. As shown, the panel 36*c* includes an elevated light 36*d*.

Figure 8:
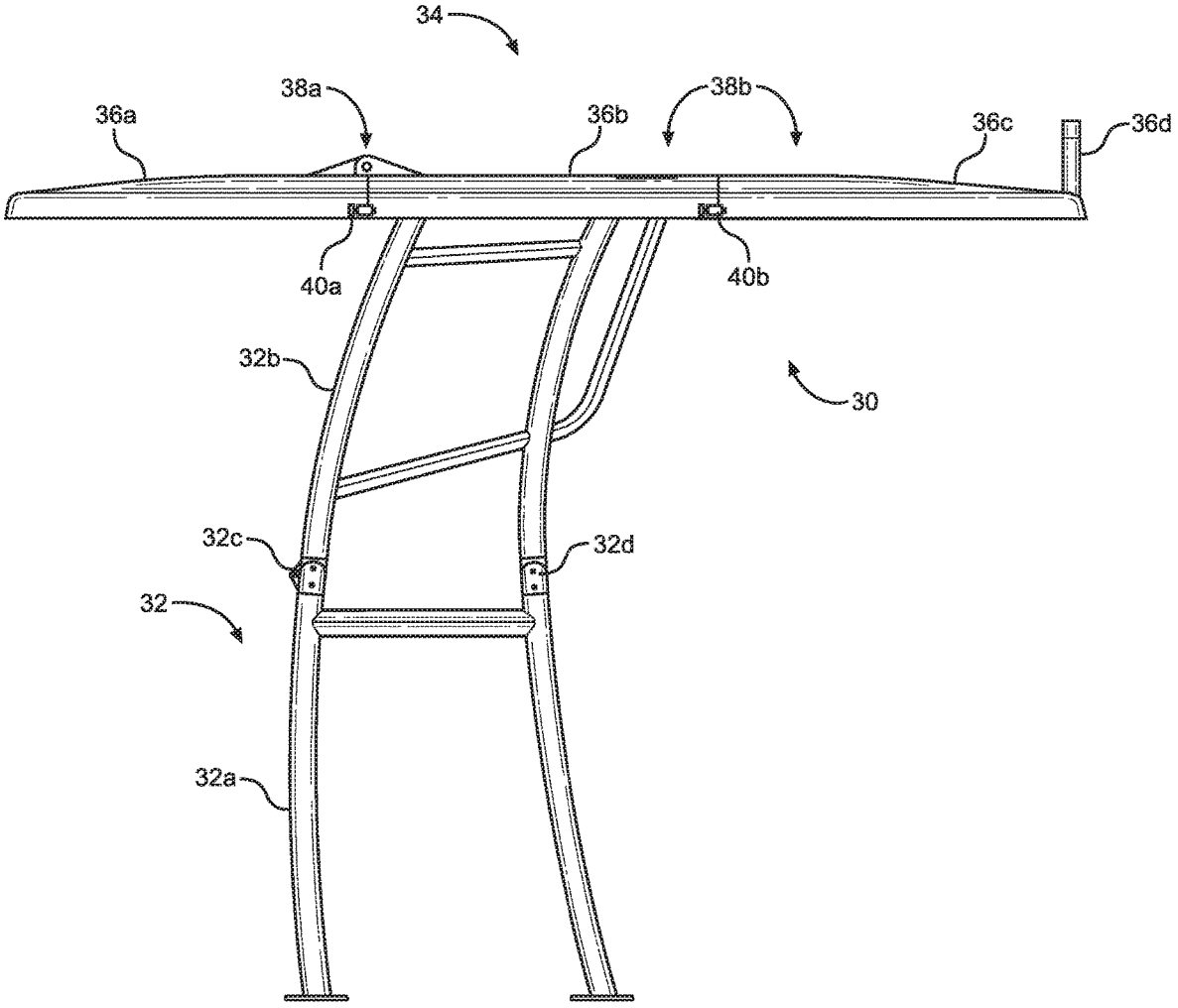
FIGS. 8-11 show another embodiment of a pivoting and folding rigid panel boat top according to the disclosure.

Also, as will be observed, the rigid panels 36*a*-36*c* are crowned in the manner of the panels 16*a* and 16*b* so they are higher at the top center. This is advantageous so that water can run off in all directions without puddling. This also offers a vertical spaced, butt joint formed with the hinges 38*a* and 38*b* and latches 40*a* and 40*b*. Thus, the cover 34 may have the hinges 38*a* and 38*b* at the top with the latches 40*a* and 40*b* placed lower at the sides and/or on the underside of the rigid panels 36*a*-36*c*. When viewed from the side such as shown in FIG. 8, a vertical distance is provided between the hinges 38*a* and 38*b* and the latches 40*a* and 40*b* at the sides. This enables the panels 36*a*-36*c* to be cantilevered from the another, and self-supporting.

The hinge 38*a* may be a butt hinge and the hinge 38*b* is preferably a butterfly hinge, but other types of hinges may be used.

The latches 40*a* and 40*b* are preferably lockable latches or knobs that maintain the panels adjacent one another during use.

Figure 9:
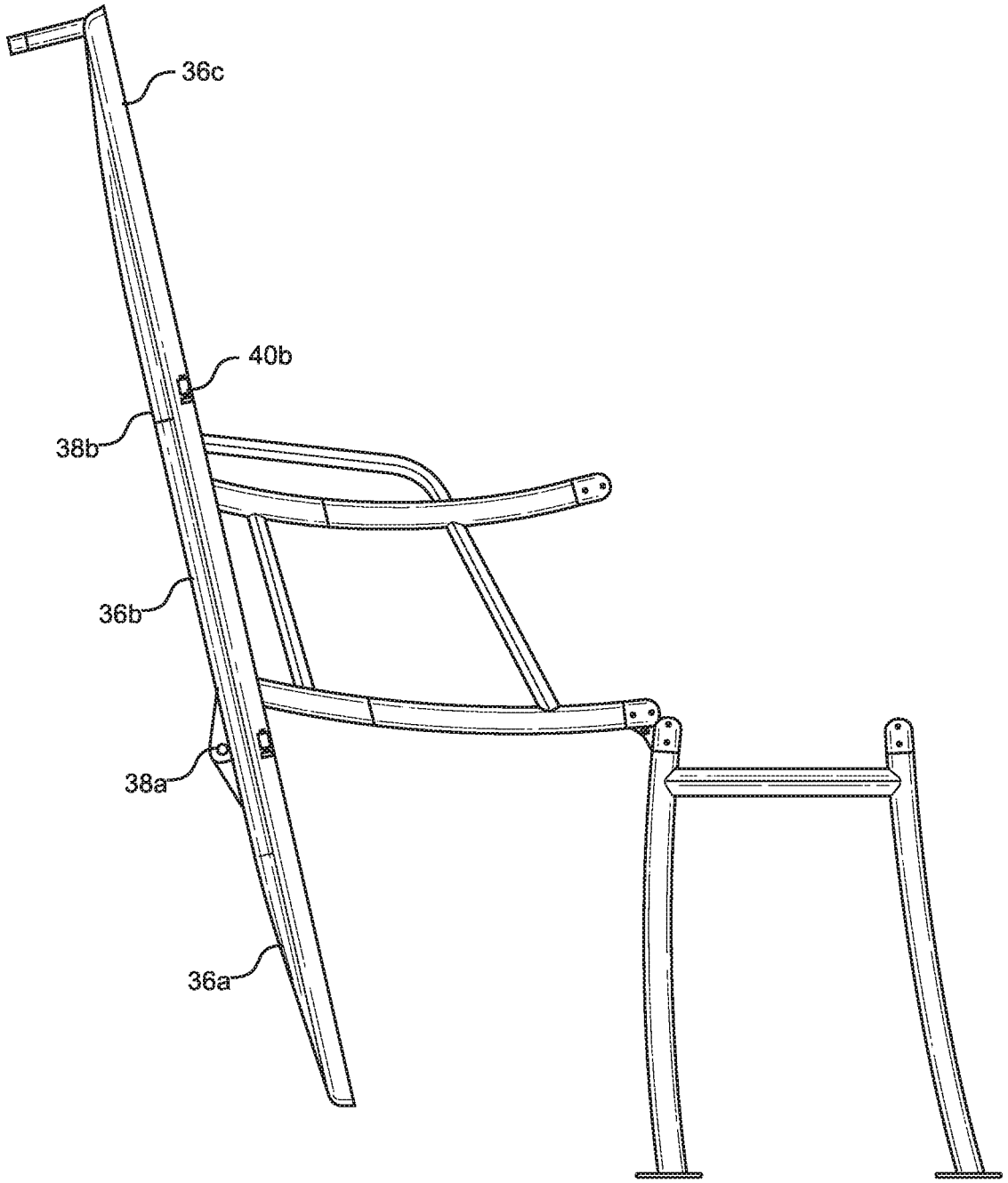
Figure 10:
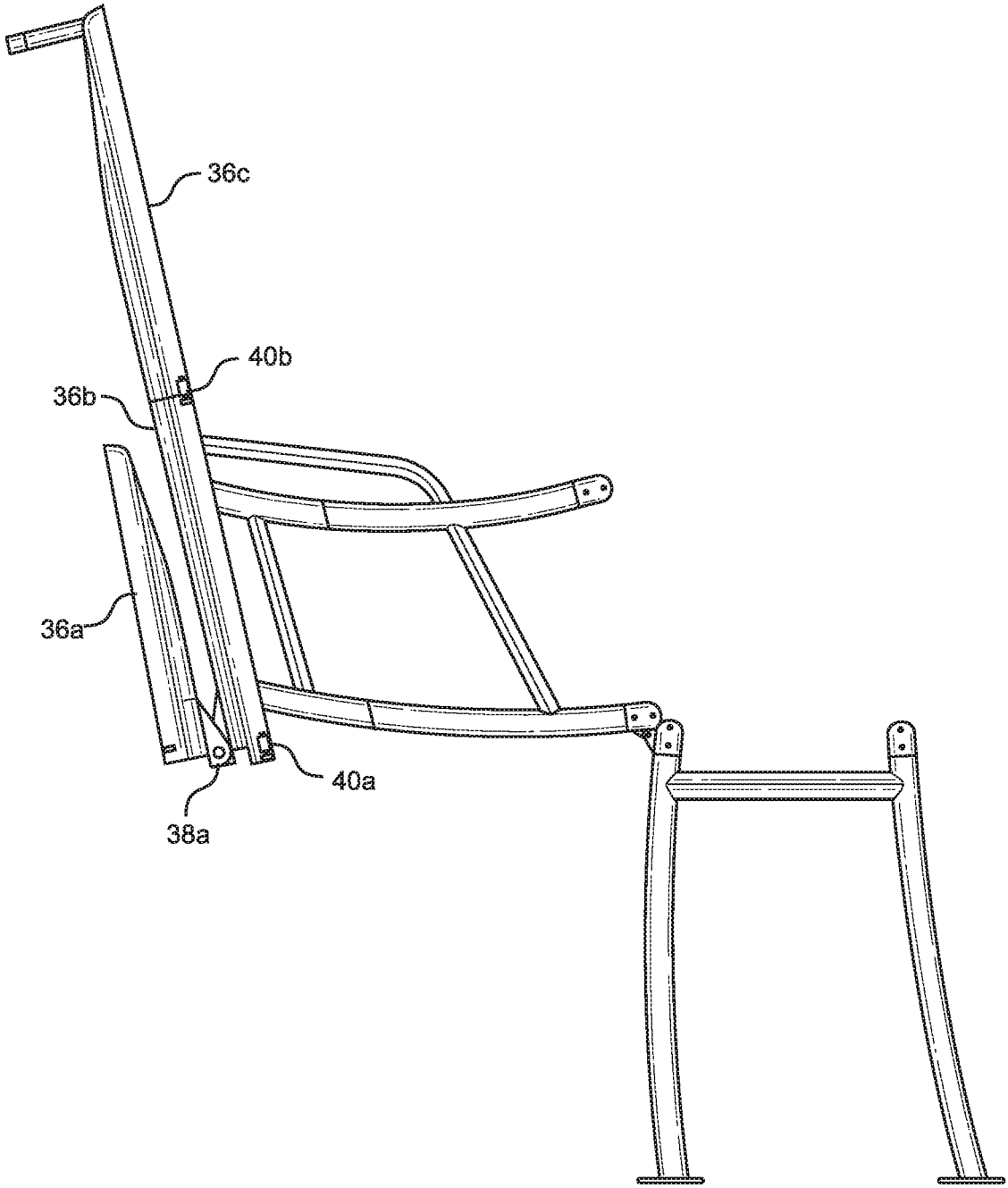
Figure 11:
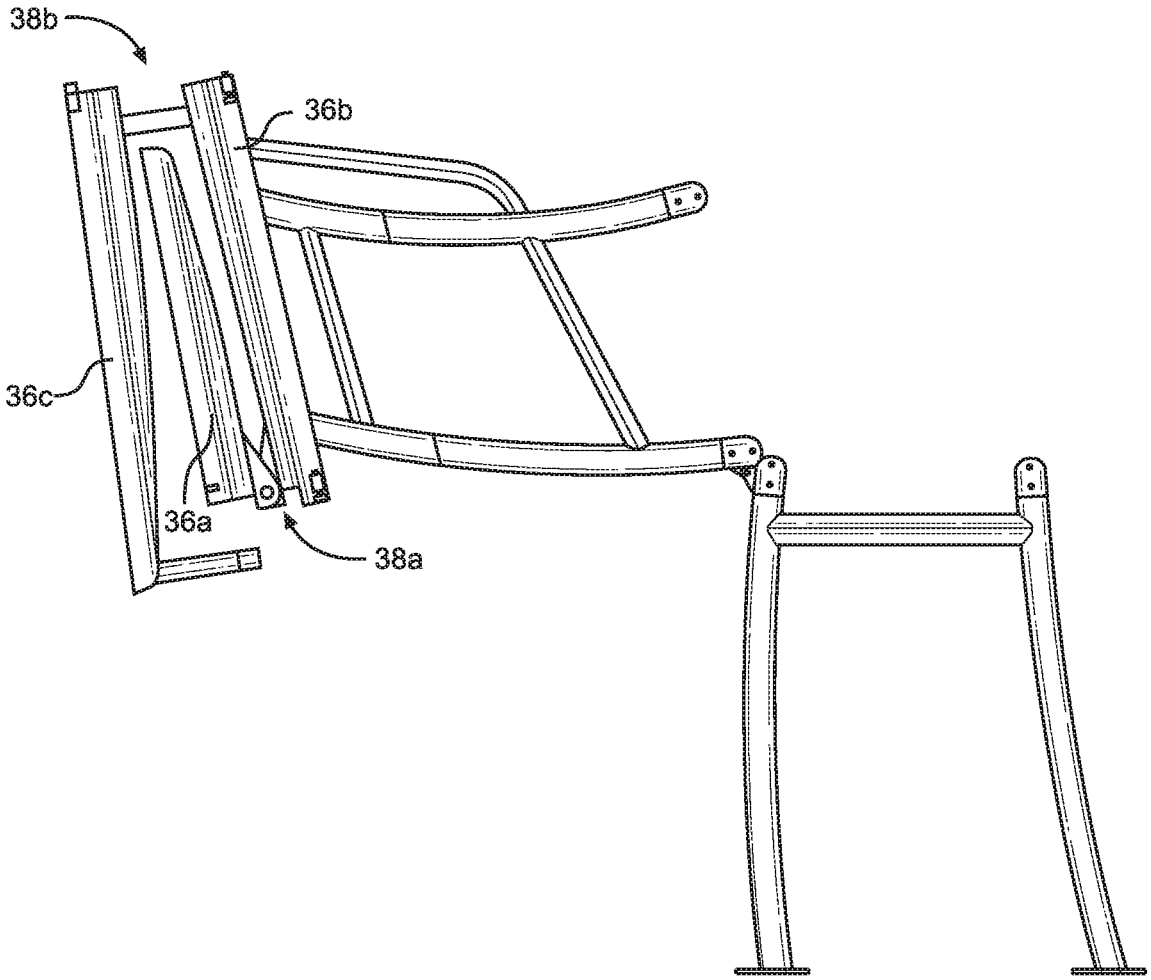

FIGS. 8-11 depict pivoting and folding of the boat top 30 from a use or erect orientation to a storage position. As shown, to orient the top 30 from an erected configuration (FIG. 8) to a stowed configuration (FIG. 11), the latch 32*d* is disengaged, and the upper tower portion 32*b* is pivoted forward as seen in FIG. 9 until it is fully pivoted forward. Next, as seen in FIG. 10, the latches 40*a* are disengaged and the forward panel 36*a* is pivoted or folded upward and positioned in front of an alongside the mid panel 36*b*. Next, as seen in FIG. 11, the latch 40*b* is disengaged and the aft panel 36*c* is folded over to the forward panel 36*a* to provide a compact storage condition for the top 30. The butt hinge 38*b* advantageously provides clearance to space the aft panel 36*c* from the mid panel 36*b*, with such space being occupied by the forward panel 36*a*.

Thus, as shown the top 30 is pivotable and foldable from an erected orientation in which the upper rigid tower 32*b* is positioned directly above the lower rigid tower 32*a* and the rigid panels 36*a*-36*c* are oriented in a parallel planar relationship above the upper rigid tower 12*b* to a storage orientation. In the storage orientation the upper rigid tower 32*b* is pivoted relative to the to the lower rigid tower 32*a* and the rigid panels 36*a*-36*c* are oriented in a folded orientation relative to one another. The panels 36*a*-36*c* are likewise connected to the starboard tower which is pivoted in a similar manner and simultaneously with the port tower.

Figure 12:
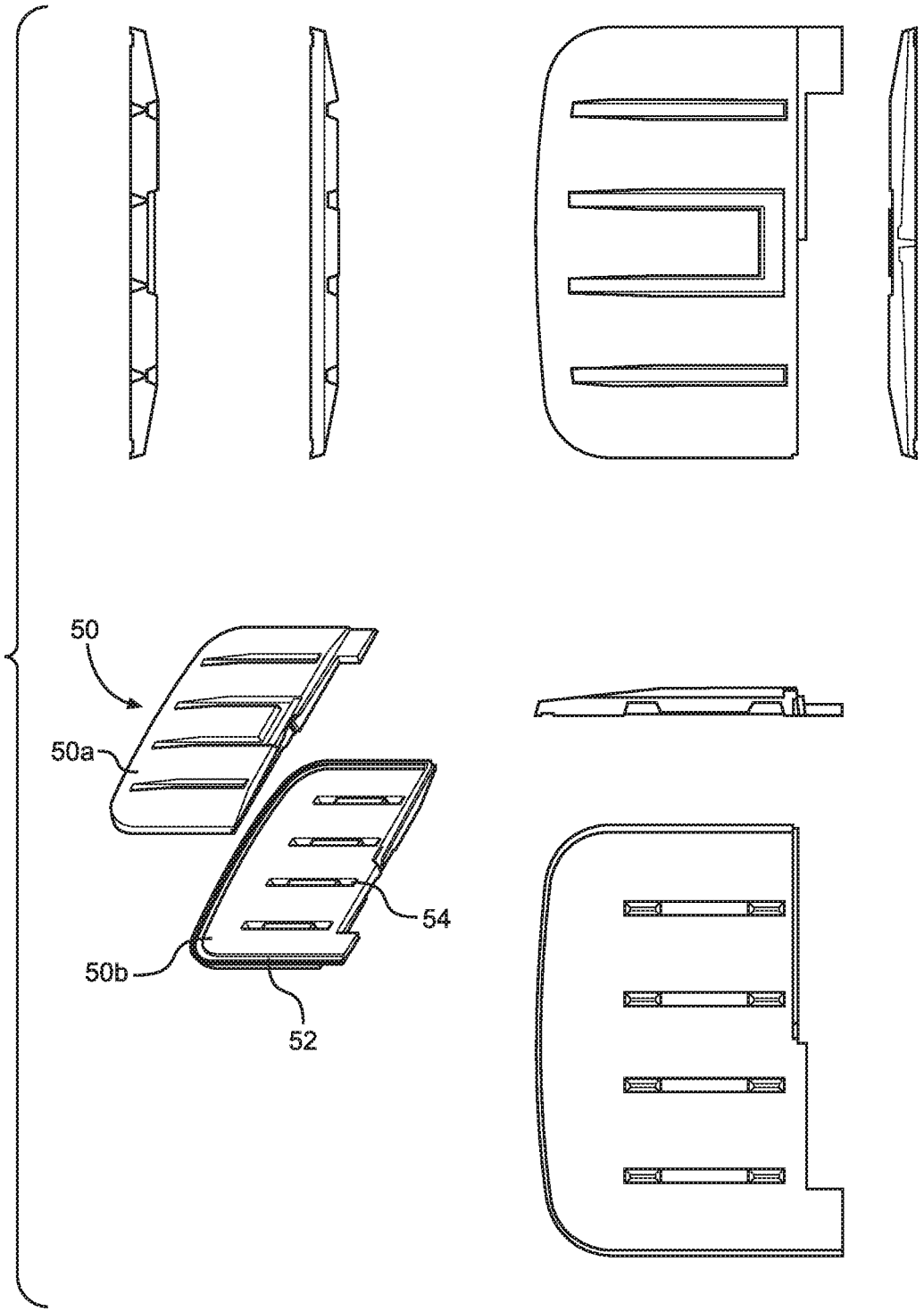
FIGS. 12-14 show an alternate construction of a rigid panel for use with the boat tops of the disclosure.
Figure 13:
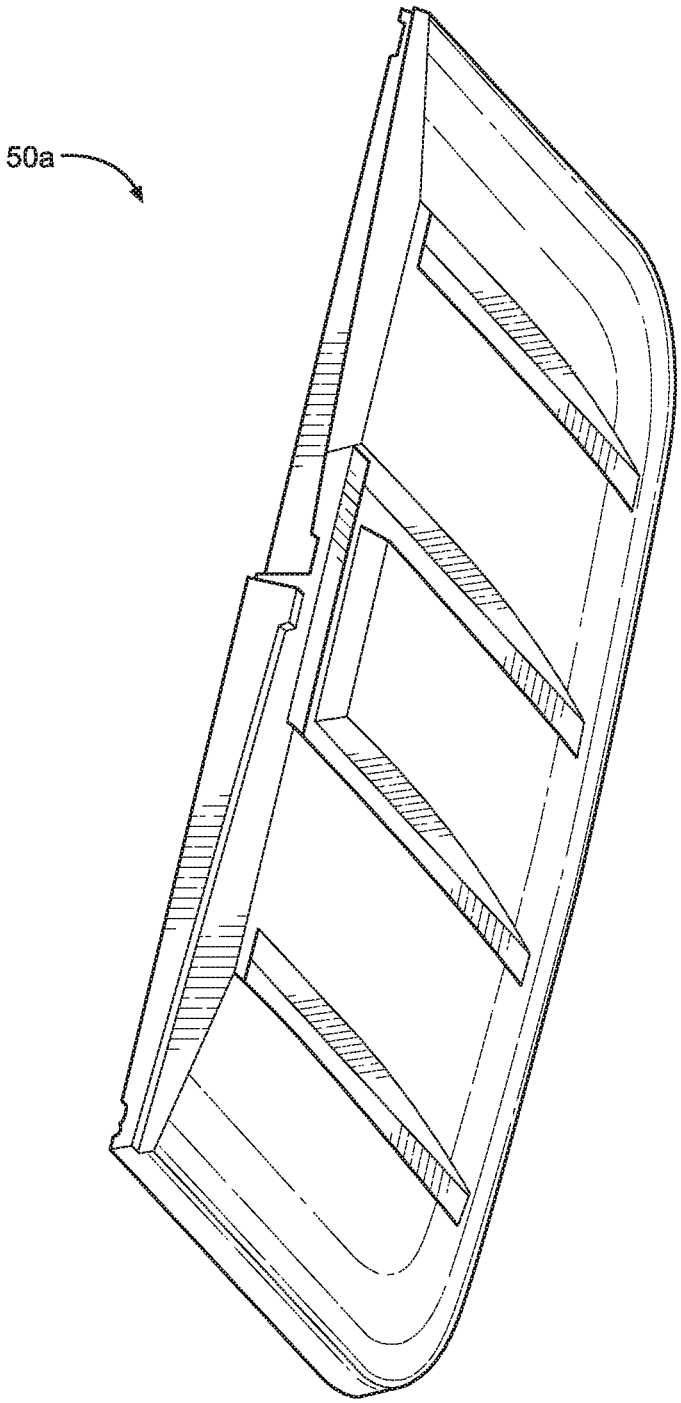
Figure 14:
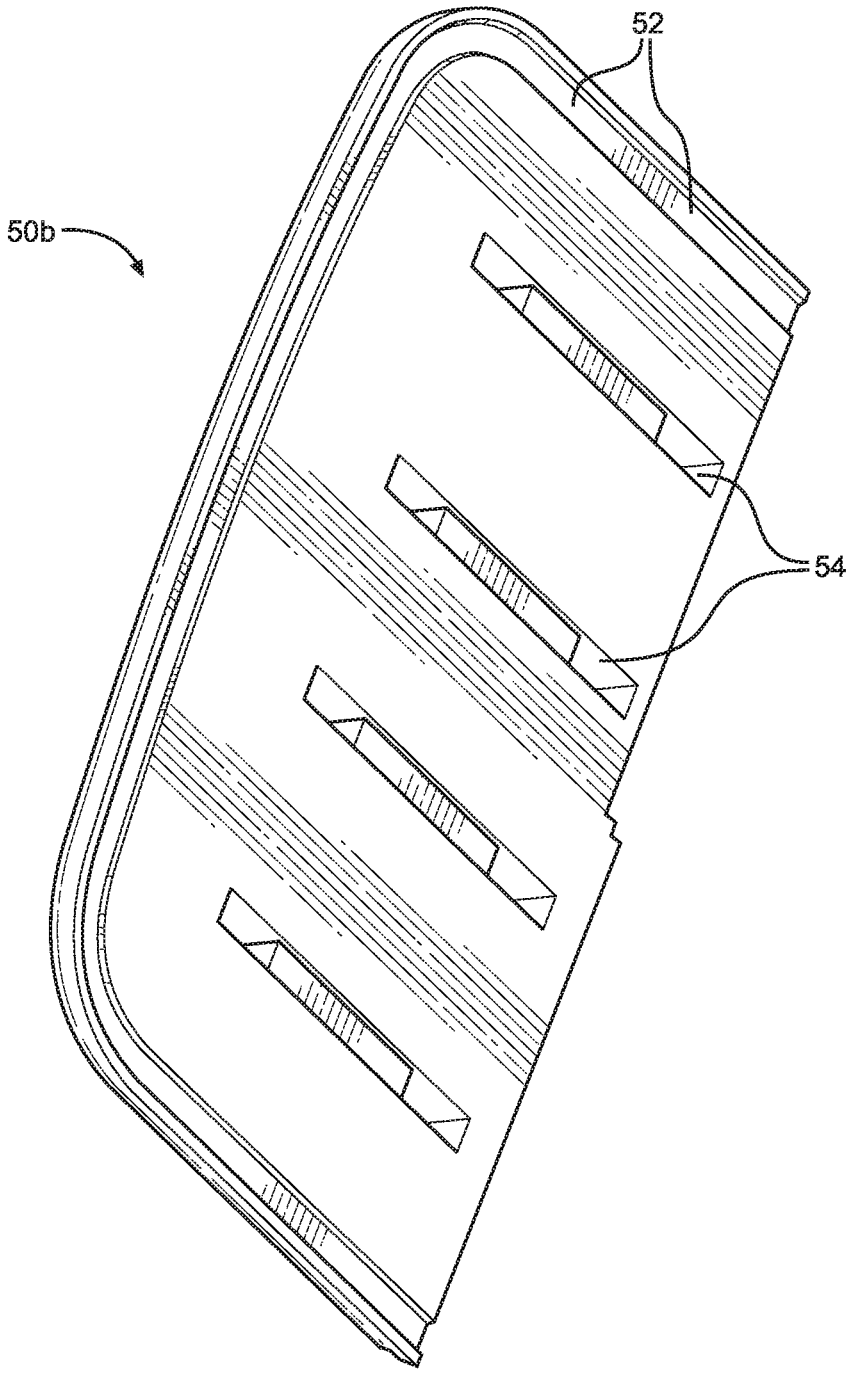

FIGS. 12-14 show an alternate construction of a rigid panel 50 for use with the boat tops of the disclosure. The panel 50 is dual skinned having a top molded member 50*a* and bottom molded member 50*b*. A drip guard 52 is formed on an underside perimeter surface of the bottom molded member 50*b* to help channel water to drain away from the cover and not drip on persons under the cover. Storage or pocket areas 54 may be provided. Also, if desired, a foam material may be added to fill the space contained between the upper, the sides, and underside surfaces.

Figure 15:
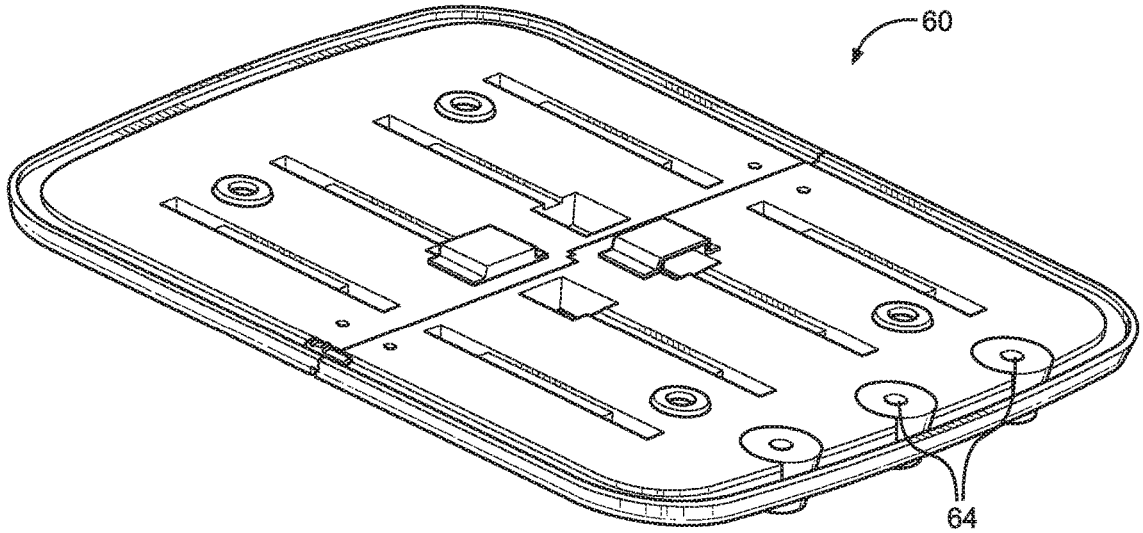
FIGS. 15-18 show further construction of a rigid panel for use with the boat tops of the disclosure incorporating molded structures therein for a variety of purposes.
Figure 16:
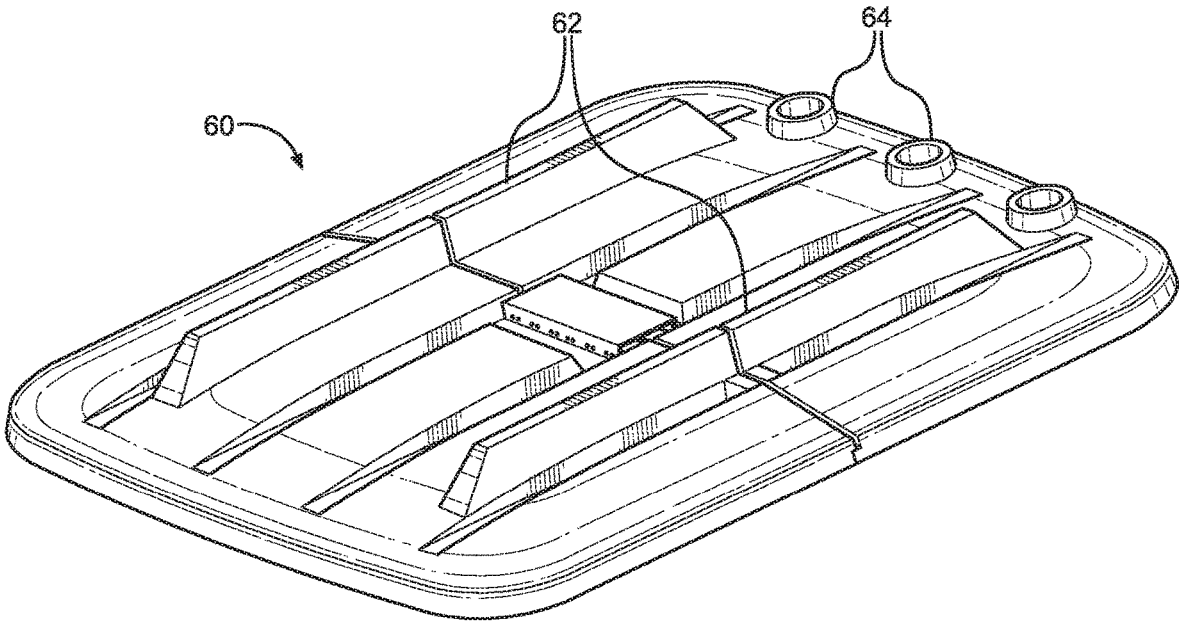
Figure 17:
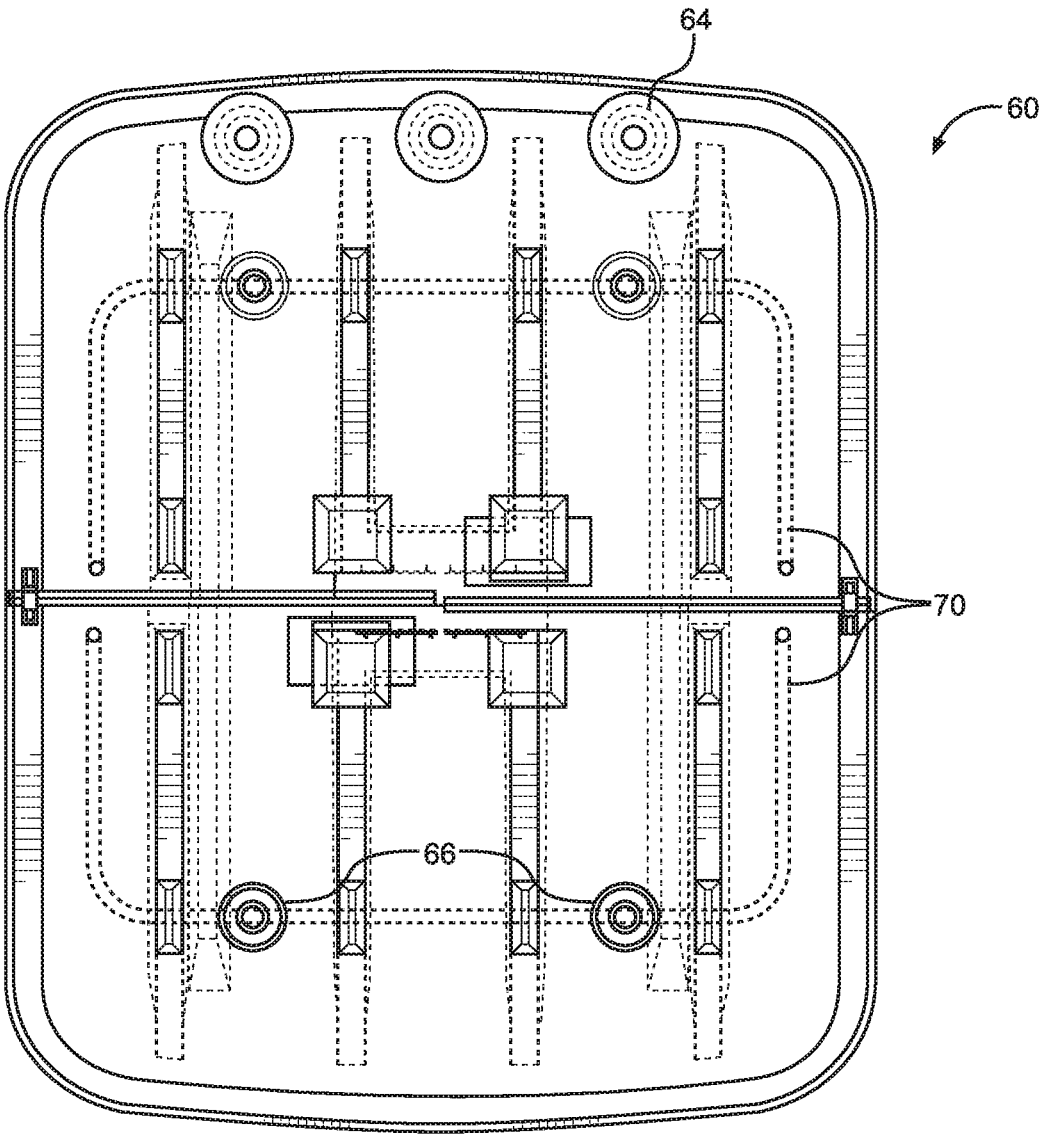
Figure 18:
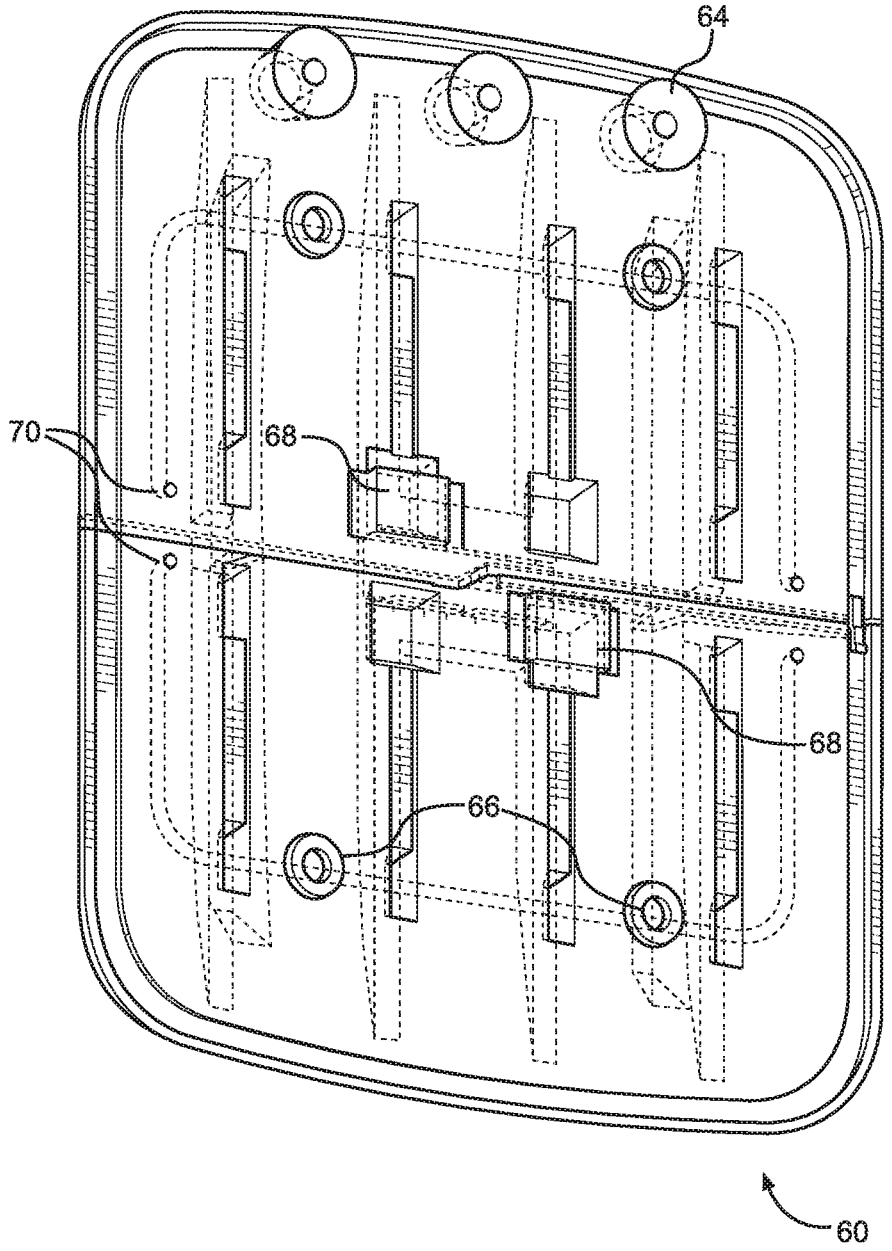

FIGS. 15-18 show further construction of a rigid panel 60 for use with the boat tops of the disclosure incorporating molded structures therein for a variety of purposes. For example, the panel 60 includes raised rails 62 for storage purposes, fishing pole holders 64, lighting or speaker bezels 66, storage pockets 68, and wiring chases 70. FIG. 16 is a view of the upper surface of the panel 60, and FIG. 15 shows the underside. FIGS. 17 and 18 further illustrate internal features such as the chases 70.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A top mountable on a boat, the top comprising:
a lower rigid tower portion;
an upper rigid tower portion pivotally connected to the lower rigid tower portion; and
a cover connected to the upper tower portion, the cover comprising a plurality of molded plastic rigid panels hingedly connected to one another,
wherein the top is pivotable and foldable from an erected orientation in which the upper rigid tower portion is positioned directly above the lower rigid tower portion and the rigid panels are oriented in a parallel planar relationship above the upper rigid tower portion to a storage orientation in which the upper rigid tower portion is pivoted relative to the to the lower rigid tower portion and the rigid panels are oriented in a folded orientation relative to one another.

2. The top of claim 1, wherein the plurality of rigid panels comprises two rigid panels.

3. The top of claim 1, wherein the plurality of rigid panels comprises three rigid panels.

4. The top of claim 1, wherein the rigid panels are dual skinned having a top molded member and bottom molded member.

5. The top of claim 1, wherein the rigid panels are molded to include one or more of the following raised storage rails, fishing pole holders, lighting or speaker bezels, storage pockets, and wiring chases.

6. The top of claim 1, further including a tower latch for maintaining the upper rigid tower portion directly above the lower rigid tower portion when the top is in the erected orientation, the tower latch being operable to release the upper rigid tower portion to be pivoted to the storage orientation.

7. The top of claim 1, further including a panel latch for maintaining the the rigid panels oriented in the parallel planar relationship when the top is in the erected orientation, the panel latch being operable to release the panels to enable the panels to be folded.

8. A top mountable on a boat, the top comprising:
a pair of spaced apart tower portions; and
a cover connected to each of the tower portions, the cover comprising a plurality of molded plastic rigid panels hingedly connected to one another, wherein the cover is foldable from a deployed orientation where the rigid panels are oriented in a parallel planar relationship to a storage orientation in which the rigid panels are oriented in a folded orientation relative to one another.

9. The top of claim 8, wherein the plurality of rigid panels comprises two rigid panels.

10. The top of claim 8, wherein the plurality of rigid panels comprises three rigid panels.

11. The top of claim 8, wherein the rigid panels are dual skinned having a top molded member and bottom molded member.

12. The top of claim 8, wherein the rigid panels are molded to include one or more of the following: raised storage rails, fishing pole holders, lighting or speaker bezels, storage pockets, and wiring chases.

13. The top of claim 8, further including a panel latch for maintaining the the rigid panels oriented in the parallel planar relationship when the cover is in the deployed orientation, the panel latch being operable to release the panels to enable the panels to be folded.

14. A top mountable on a boat, the top comprising:
a pair of spaced apart tower portions;
a cover connected to each of the tower portions, the cover comprising a plurality of rigid panels hingedly connected to one another, wherein the cover is foldable from a deployed orientation where the rigid panels are oriented in a parallel planar relationship to a storage orientation in which the rigid panels are oriented in a folded orientation relative to one another; and
a panel latch for maintaining the rigid panels oriented in the parallel planar relationship when the cover is in the deployed orientation, the panel latch being operable to release the panels to enable the panels to be folded.

15. The top of claim 14, wherein the plurality of rigid panels comprises two rigid panels.

16. The top of claim 14, wherein the plurality of rigid panels comprises three rigid panels.

17. The top of claim 14, wherein the rigid panels are molded plastic.

18. The top of claim 14, wherein the rigid panels are dual skinned having a top molded member and bottom molded member.

19. The top of claim 14, wherein the rigid panels are molded to include one or more of the following raised storage rails, fishing pole holders, lighting or speaker bezels, storage pockets, and wiring chases.

20. The top of claim 14, further including a panel latch for maintaining the the rigid panels oriented in the parallel planar relationship when the cover is in the deployed orientation, the panel latch being operable to release the panels to enable the panels to be folded.

* * * * *